US005473904A

United States Patent [19]

Guo et al.

[11] Patent Number: 5,473,904

[45] Date of Patent: Dec. 12, 1995

[54] METHOD AND APPARATUS FOR GENERATING, TRANSPORTING AND DISSOCIATING GAS HYDRATES

[75] Inventors: Boyun Guo; Robert E. Bretz; Robert L. Lee, all of Socorro, N.M.

[73] Assignee: New Mexico Tech Research Foundation, Socorr, N.M.

[21] Appl. No.: 152,302

[22] Filed: Nov. 12, 1993

[51] Int. Cl.[6] ..... F17C 11/00

[52] U.S. Cl. ..... 62/46.1; 62/46.2; 62/59; 585/15

[58] Field of Search ..... 62/1, 45, 46.2, 62/53.2, 59, 66, 69, 46.1; 585/15

[56] References Cited

U.S. PATENT DOCUMENTS

| | | | |
|---|---|---|---|
| 2,270,016 | 1/1942 | Benesh | 48/190 |
| 2,356,407 | 8/1944 | Hutchinson | 260/676 |
| 2,375,559 | 5/1963 | Hutchinson | 48/190 |
| 3,217,503 | 11/1965 | Mitchell et al. | 62/46.2 |
| 3,514,274 | 5/1970 | Cahn et al. | 48/190 |
| 3,975,167 | 8/1976 | Nierman | 48/190 |
| 4,147,456 | 4/1979 | Klass | 62/45 X |
| 4,347,707 | 9/1982 | Zemelman et al. | 62/46.2 X |
| 4,393,660 | 7/1983 | Kleiner et al. | 62/69 |
| 4,404,807 | 9/1983 | Zemelman et al. | 62/46.2 X |
| 4,487,023 | 12/1984 | Hegadorn et al. | 62/1 |
| 4,540,501 | 9/1985 | Ternes et al. | 62/59 X |
| 4,821,794 | 4/1989 | Tsai et al. | 62/59 X |
| 4,920,752 | 5/1990 | Ehrsam | 62/46.1 |
| 4,930,319 | 6/1990 | Bee et al. | 62/46.1 X |
| 4,934,153 | 6/1990 | Ebihuma et al. | 62/66 |
| 5,261,490 | 11/1993 | Ebihuma | 166/266 |
| 5,304,356 | 4/1994 | Iijima et al. | 422/226 |
| 5,364,611 | 11/1994 | Iijima et al. | 423/437 R |

OTHER PUBLICATIONS

M. Burshears, et al., "A Multi–Phase, Multi–Dimensional, Variable Composition Simulation of Gas Production From a Conventional Gas Reservoir in Contact With Hydrates," *Presentation at the Unconventional Gas Technology Symposium of the Society of Petroleum Engineers* held in Louisville, Ky., May 18–21, 1986 (SPE 15246, pp. 449–456).

K. Domionic, et al., "Gas Production From Depressurization of Bench–Scale Methane Hydrate Reservoirs," *U.S. Department of Energy,* DOE/METC–87/4073, pp. 1–9, Mar. 1987.

G. B. Guo, et al., "Gas Hydrates Decomposition and Its Modeling," 1992 *International Gas Research Conference,* New Mexico Institute of Mining and Technology (1992).

G. D. Holder, et al., "Simulation of Gas Production From a Reservoir Containing Both Gas Hydrates and Free Natural Gas," *Presentation at the 57th Annual Fall Technical Conference and Exhibition of the Society of Petroleum Engineers of AIME* held in New Orleans, La., Sep. 26–29, 1982 (SPE 11105, pp. 1– 6).

V. A. Kamath, et al., "Dissociation Heat Transfer Characteristics of Methane Hydrates," AIChE *Journal,* vol. 33, No. 2, pp. 347–350, Feb. 1987.

V. A. Kamath, et al., "Evaluation of Hot–Brine Stimulation Technique for Gas Production From Natural Gas Hydrates," *Journal of Petroleum Technology,* pp. 1379–1388, Nov. 1987.

V. A. Kamath, et al., "Experimental Study of Brine Injection and Depressurization Methods for Dissociation of Gas Hydrates, " *Presentation at the 64th Annual Technical Conference and Exhibition of the Society of Petroleum Engineers* held in San Antonio, Tex., Oct. 8–11, 1989, (SPE 19810, pp. 1–10)

(List continued on next page.)

*Primary Examiner*—Christopher Kilner

*Attorney, Agent, or Firm*—Donovan F. Duggan; Deborah A. Peacock; Jeffrey D. Myers; Rod D. Baker

[57] ABSTRACT

Methods and apparatus for generating, transporting and dissociating gas hydrates are disclosed. The preferred apparatus includes a mobile tank initially containing liquid water. Compressed hydrate-forming gas is combined in a pipe with the liquid water under locally supercooled conditions. The formed gas hydrate is blown into the mobile tank for transport and eventual consumption.

20 Claims, 3 Drawing Sheets

OTHER PUBLICATIONS

V. A. Kamath, et al., "Three Phase Interfacial Heat Transfer During the Dissociation of Propane Hydrates," *Chemical Engineering Science,* vol. 39, No. 10, pp. 1435–1442, 1984.

H. C. Kim, et al., "Kinetics of Methane Hydrate Decomposition," *Chemical Engineering Science,* vol. 42, No. 7, pp. 1645–1653, 1987.

P. L. McGuire, "Methane Hydrate Gas Production: An Assessment of Conventional Production Technology as Applied to Hydrate Gas Recovery," *Los Alamos National Laboratory,* pp. 1–17, Nov. 1981, LA–9102–MS.

M. S. Selim, et al., "Hydrate Dissociation in Sediment," *Presentation at the 62nd Annual Technical Confernece and Exhibition of the Society of Petroleum Engineers* held in Dallas, Tex., Sep. 27–30, 1987, (SPE 16859, pp. 243–258).

M. S. Selim, et al., "Modeling of the Dissociation of an In–Situ Hydrate," *Presentation at the SPE 1985 California Regional Meeting* held in Bakersfield, Calif., Mar. 27–29, (SPE 13597, pp. 75–80).

E. D. Sloan, Jr., "Clathrate Hydrates of Natural Gases," *Marcel Dekker, Inc.,* pp. 12–16, 1990.

J. W. Ullerich, et al., "Theory and Measurement of Hydrate Dissociation," *AIChE Journal,* vol. 33, No. 5, pp. 747–752, May 1987.

M. H. Yousif, et al., "Experimental and Theoretical Investigation of Methane Gas Hydrate Dissociation in Porous Media," *Presentation at the 63rd Annual Technical Conference and Exhibition of the Society of Petroleum Engineers* held in Houston, Tex., Oct. 2–5, 1988 (SPE 18320, pp. 571–583).

METHOD AND APPARATUS FOR GENERATING, TRANSPORTING AND DISSOCIATING GAS HYDRATES

BACKGROUND OF THE INVENTION

1. Field of the Invention (Technical Field)

The invention relates to a method of generating, transporting and dissociating gas hydrates, specifically natural gas and other hydrate-forming gases; and apparatus therefor.

2. Background Art

Gas hydrates are compounds having crystalline structure known as clathrates. Gas molecules are physically entrapped or caged in expanded lattices of water ice comprising hydrogen-bonded water molecules. The structure is stable due to weak van der Waals' bonding of the gas molecules within the water molecule "cages." Structure I clathrate hydrates comprise eight cavities (tetrakaidecahedral) for each 46 water molecules, and the entrapped gases may consist of methane, ethane, carbon dioxide, and hydrogen sulfide. Structure II clathrates (hexakaidecahedral cavities) contain 24 cavities for every 136 water molecules, and usually accommodate larger gas molecules, such as propane and isobutane. Natural gas, with its plurality of components, may form either Structure I or Structure II clathrates.

Clathrate hydrates occur naturally in permafrost or deep-ocean environments, thus are considered an important natural resource. Utilizing such a resource requires understanding of gas hydrate formation and dissociation. "Kinetics of Methane Hydrate Decomposition," Kim, et al., *Chemical Engineering Science,* Vol. 42, No. 7, pp. 1645–1653 (1987) discusses the kinetics of methane hydrate decomposition, indicating that pressure dependence further depends on the difference in gas fugacities at equilibrium pressure and decomposition pressure. "A Multi-Phase, Multi-Dimensional, Variable Composition Simulation of Gas Production from a Conventional Gas Reservoir in Contact with Hydrates," Burshears, et al., *Unconventional Gas Technology Symprouis of the Society of Petroleum Engineers,* pp. 449–453 (1986), discusses dissociation of hydrates by depressurization without an external heat source. "Hydrate Dissociation in Sediment" Selim, et al., 62*d Annual Technical Conference and Exhibition of the Society of Petroleum Engineers,* pp. 243–258 (1987) relates rate of hydrate dissociation with thermal properties and porosity of the porous media. "Methane Hydrate Gas Production: An Assessment of Conventional Production Technology as Applied to Hydrate Gas Recovery," McGuire, *Los Alamos National Laboratory,* pp. 1–17 (1981) discusses feasibility of hydrate gas production by both thermal stimulation and pressure reduction. "Gas Hydrates Decomposition and Its Modeling", Guo, et al., 1992 *International Gas Research Conference,* pp. 243–252 (1992), attributes difference in chemical potential as the driving force for hydrate dissociation.

U.S. Pat. No. 2,375,559, to Hutchinson, et al., entitled *Treatment of Hydrocarbon Gases,* discloses a method of forming hydrates by cooling and dispersing the components when combining the components. Similarly, U.S. Pat. No. 2,356,407, to Hutchinson, entitled *System for Forming and Storing Hydrocarbon Hydration,* discloses hydrate formation using water and a carrier liquid. U.S. Pat. No. 2,270,016, to Benesh, discloses hydrate formation and storage using water and alcohol, thereby forming blocks of hydrate to be stored.

U.S. Pat. No. 3,514,274 to Cahn, et al., entitled *Transportation of Natural Gas as a Hydrate,* discloses transportation of natural gas as a hydrate aboard ship. The system uses propane or butane as a carrier. U.S. Pat. No. 3,975,167, to Nierman, entitled *Transportation of Natural Gas as a Hydrate*, discloses undersea formation and transportation of natural gas hydrates. U.S. Pat. No. 4,920,752, to Ehrsam, entitled *Apparatus and Process for Storing Hydrate-Forming Gaseous Hydrocarbons*, relates to both hydrate formation and storage wherein one chamber of a reservoir is charged with hydrate while another chamber is evacuated by decomposition of hydrate into gas and ice.

None of the cited prior art, however, teaches methods and apparatus of generating and transporting clathrate hydrates wherein a mobile tank truck supplies water for clathrate hydrate generation, and thereafter transports hydrates in the now-vacant tank.

SUMMARY OF THE INVENTION (DISCLOSURE OF THE INVENTION)

The preferred method of the invention comprises a method of forming clathrate hydrates further comprising the steps of pressurizing a hydrate-forming gas, cooling liquid water below the gas-water-hydrate equilibrium curve, combining the hydrate-forming gas and the liquid water while locally supercooling the gas, and thereby forming a clathrate hydrate.

The method further comprises providing liquid water from a mobile tank and pumping the liquid water under a pressure of approximately 300 psi from the mobile tank. The preferred method of the invention comprises compressing the hydrate-forming gas to a pressure of at least approximately 400 psi and combining the gas and the liquid water while locally supercooling the gas by releasing it through a nozzle. The method further comprises the step of blowing the clathrate hydrate into the mobile tank.

The preferred method of the invention further comprises the step of dissociating the clathrate hydrate into hydrate-forming gas and water by isothermally depressurizing the clathrate hydrate.

The preferred apparatus of the invention comprises means for pressurizing a hydrate-forming gas means for cooling liquid water below the gas-water-hydrate equilibrium curve, and means for combining the hydrate-forming gas and liquid water while locally supercooling the gas; thereby forming clathrate hydrate.

The preferred apparatus of the invention further comprises means for providing liquid water from a pressurized mobile tank, means for pumping liquid water from the pressurized mobile tank, and means for pressurizing the hydrate-forming gas to a pressure of at least 400 psi. The preferred apparatus of the invention further comprises means for combining the hydrate-forming gas and liquid water while locally supercooling the gas by releasing the gas through a nozzle. The apparatus further comprises means for blowing the clathrate hydrate into the pressurized mobile tank, and means for dissociating the clathrate hydrate into hydrate-forming gas and water by isothermally depressurizing the clathrate hydrate.

The preferred apparatus of the invention also comprises means comprising a mobile tank for storing and transporting liquid water, means for pumping the liquid water into a chiller, means for compressing and feeding hydrate-forming gas into the chiller, and means for locally supercooling the hydrate-forming gas. The preferred apparatus of the invention also comprises means for combining the liquid water and hydrate-forming gas to form clathrate hydrates, and means for blowing the clathrate hydrates into the mobile tank.

The preferred apparatus of the invention further comprises a mobile tank comprising means for pressurizing the liquid water and clathrate hydrate at approximately 300 psi at a temperature of approximately 33° F. The apparatus further comprises a nozzle for locally supercooling the hydrate-forming gas, and a pipe for combining the liquid water and hydrate-forming gas.

The preferred apparatus of the invention further comprises a chiller for cooling both the liquid water and hydrate-forming gas to a temperature of approximately 34° F. The apparatus also comprises means for selectively connecting the mobile tank to the remainder of said apparatus for forming clathrate hydrates.

A primary object of the invention is the economical formation, transportation and dissociation of clathrate hydrates;

Another object of the invention is the formation and dissociation of clathrate hydrates under isothermal conditions;

Still another object of the invention is the provision of transporting liquid water and hydrate in the same vehicle;

Yet another object of the invention is the formation of hydrates by combining gas and liquid water under locally supercooled conditions;

An advantage of the invention is formation and transportation of gas hydrates under low temperature and pressure;

Another advantage of the invention is the relative ease and low cost of transporting gas hydrates in mobile tanks;

Still another advantage of the invention is its adaptability to gas hydrate transport in relatively undeveloped areas.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

BEST MODES FOR CARRYING OUT THE INVENTION

Figure 1:
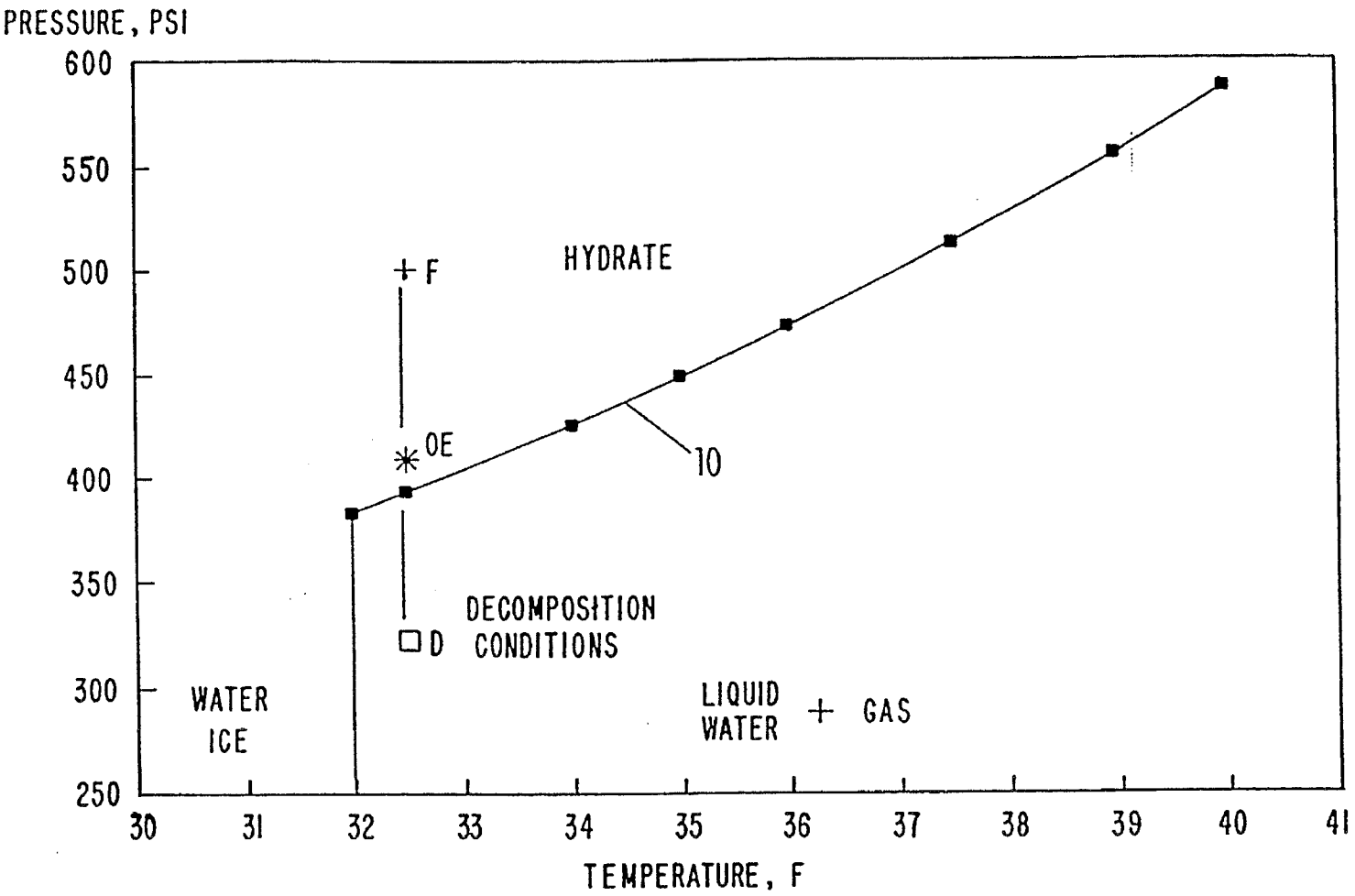
FIG. 1 is a simplified phase diagram comprising methane gas-water-methane hydrate.

Reference is now made to FIG. 1 of the drawings. FIG. 1 is a simplified phase diagram of the preferred method of the invention invoking formation and dissociation of methane hydrate. Methane is a constituent gas of natural gas.

Equilibrium curve 10 is based on a mathematical model. Formation of methane hydrate from liquid water and methane gas is effected by combination of these constituents at increased pressure under substantially isothermal conditions. The formation point temperature and pressure are indicated at F.

Dissociation of methane hydrate is also effected under isothermal condition by depressurization. Point OE is the actual observed equilibrium point, substantially above predicted equilibrium curve 10.

While dissociation of methane hydrate is graphically depicted as isothermal, depressurization may necessarily result in a substantial temperature drop. Such temperature drop would move the equilibrium point downwardly along the equilibrium curve (or more precisely, a curve substantially parallel to the mathematically generated equilibrium curve). Dissociation of methane hydrate into liquid water and methane gas in FIG. 1 is depicted as occurring at point D.

Figure 2:
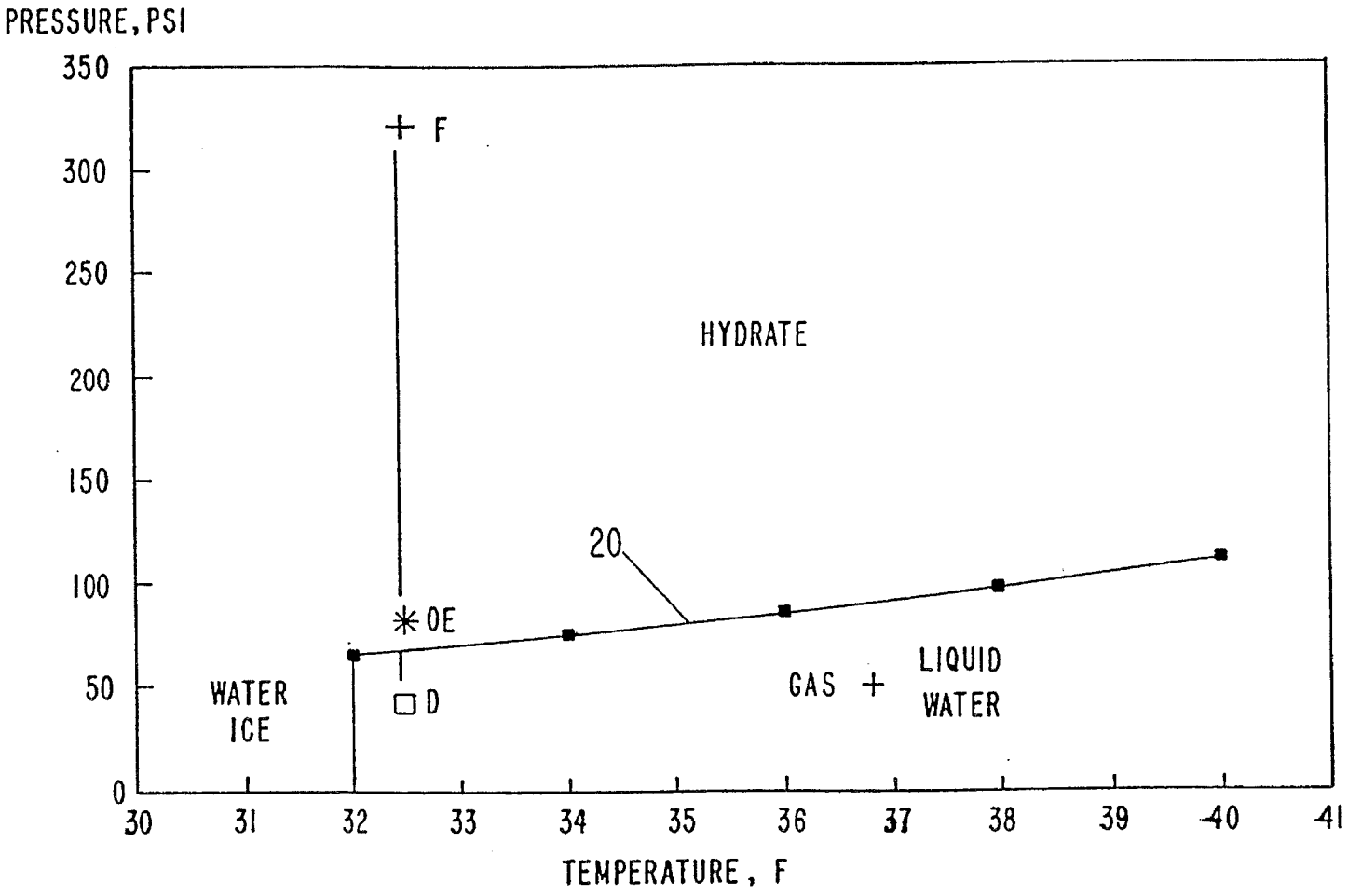
FIG. 2 is a simplified phase diagram comprising ethane gas-water-ethane hydrate.

FIG. 2 graphically presents a simplified phase diagram of ethane, yet another constituent gas of natural gas. While dissociation and formation of ethane hydrate is in many respects similar to methane hydrate, it is noted that dissociation of ethane hydrate occurs virtually instantaneously by depressurization.

Figure 3:
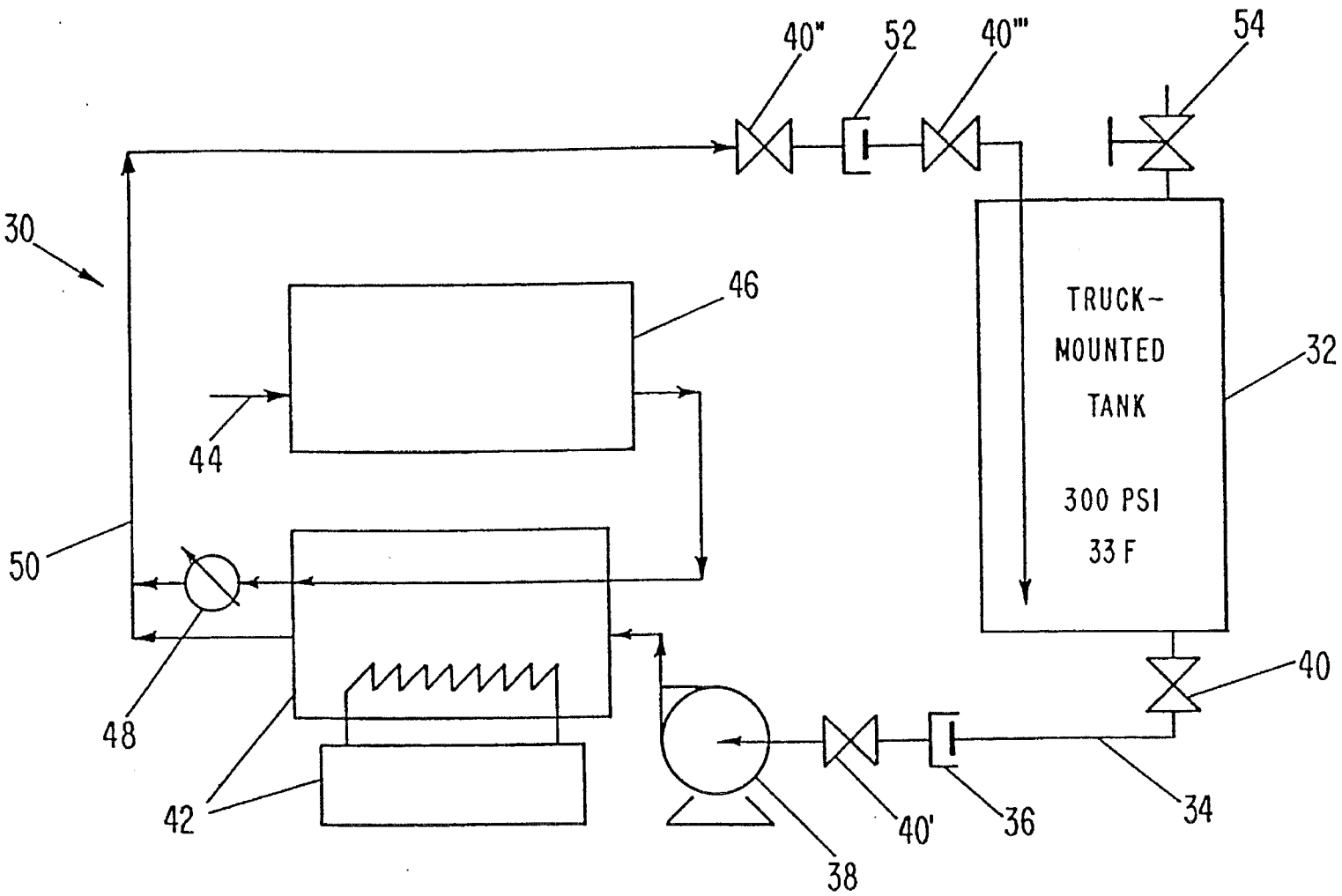
FIG. 3 is a schematic diagram of the preferred apparatus of the invention.

Reference is now made to FIG. 3 which shows the preferred apparatus of the invention. Clathrate hydrate generating apparatus 30 comprises mobile tank 32, which may comprise a railroad tank car, a truck-mounted tank and the like. Tank 32 initially contains water at any desired temperature; typically pressure is 300 psi and temperature is ambient. Water outlet line 34 is connected by means of connector 36 to water pump 38. Stop valves 40,40' provide rate-of-flow control of water prior, during and after connection ("hook up") of mobile tank 32 to the remainder of hydrate generating apparatus 30.

Water pump 38 pumps water from tank 32 to heat exchanger or chiller 42. Chiller 42 cools the water to below the gas-water-hydrate equilibrium point, as depicted in FIGS. 1 and 2, typically approximately 34° F.

Gas inlet 44 supplies the gas to be hydrated (methane, ethane, natural gas and the like) to compressor 46. Compressor 46 compresses the clathrate-forming gas to a pressure of at least approximately 400 psi.

Chiller 42 cools both clathrate-forming gas and liquid water to a temperature of approximately 34° F. Formation of hydrates results from opening nozzle valve 48, thereby locally supercooling the gas prior to combination with water. Hydrate formation thus actually occurs in pipe 50 under substantially isothermal depressurizing conditions by virtue of the gas bubbling into the water.

Existing pressure in pipe 50 blows formed hydrates through stop valves 40",40'" and connector 52 into tank 32, filling the space recently occupied by liquid water. As noted previously, pressure in tank 32 is maintained at approximately 300 psi.

After liquid water in tank 32 is depleted and the tank is filled with hydrate, tank 32 is disconnected from the remainder of the hydrate-forming apparatus and transported. The hydrates in tank 32 may be stored as dissociated into gas and liquid water for immediate consumption. Dissociation is effected isothermally by depressurization through pressure control valve 54. After the gas is exhausted from tank 32, tank 32 may again be topped off with liquid water, and the hydrate formation-dissociation cycle can be repeated.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, and of the corresponding application(s), are hereby incorporated by reference.

What is claimed is:

1. A method of forming clathrate hydrate comprising the steps of:

a) pressurizing a hydrate-forming gas;

b) cooling liquid water below the gas-water-hydrate equilibrium curve;

c) combining the hydrate-forming gas and the liquid water while locally supercooling the gas; and d) thereby forming a clathrate hydrate.

2. The method of claim 1 further comprising the step of providing liquid water from a mobile tank.

3. The method of claim 2 wherein the step of providing liquid water comprises pumping liquid water under a pressure of approximately 300 psi from the mobile tank.

4. The method of claim 1 wherein the step of pressurizing a hydrate-forming gas comprises compressing the hydrate-forming gas to a pressure of at least approximately 400 psi.

5. The method of claim 1 wherein the step of combining the gas and the liquid water while locally supercooling the gas comprises releasing the gas through a nozzle.

6. The method of claim 2 further comprising the step of blowing the clathrate hydrate into the mobile tank.

7. The method of claim 1 further comprising the step of dissociating the clathrate hydrate into hydrate-forming gas and water by isothermally depressurizing the clathrate hydrate.

8. Apparatus for forming clathrate hydrate comprising:

means for pressurizing a hydrate-forming gas;

means for cooling liquid water below the gas-water-hydrate equilibrium curve; and means for combining said hydrate-forming gas and said liquid water while locally supercooling said gas; wherein clathrate hydrate is thereby formed.

9. The apparatus of claim 8 further comprising means for providing liquid water from a pressurized mobile tank.

10. The apparatus of claim 9 wherein said means for providing liquid water comprise means for pumping liquid water from the pressurized mobile tank.

11. The apparatus of claim 8 wherein said means for pressurizing said hydrate-forming gas comprises means for compressing said hydrate-forming gas to a pressure of at least 400 psi.

12. The apparatus of claim 8 wherein said means for combining said hydrate-forming gas and said liquid water while locally supercooling said gas comprises means for releasing the gas through a nozzle.

13. The apparatus of claim 9 further comprising means for blowing said clathrate hydrate into said pressurized mobile tank.

14. The apparatus of claim 8 further comprising means for dissociating said clathrate hydrate into hydrate-forming gas and water by isothermally depressurizing said clathrate hydrate.

15. Apparatus for forming clathrate hydrates comprising:

means comprising a mobile tank for storing and transporting pressurized liquid water;

means for pumping said liquid water into a chiller;

means for compressing and feeding hydrate-forming gas into said chiller;

means for locally supercooling said hydrate-forming gas;

means for combining said liquid water and said hydrate-forming gas to form clathrate hydrates; and means for blowing said clathrate hydrates into said mobile tank.

16. The apparatus of claim 15 wherein said means comprising a mobile tank comprises means for pressurizing said liquid water and said clathrate hydrate at approximately 300 psi at a temperature of approximately 33° F.

17. The apparatus of claim 15 wherein said means for locally supercooling said hydrate-forming gas comprises a nozzle.

18. The apparatus of claim 15 wherein said means for combining said liquid water and said hydrate-forming gas comprises a pipe.

19. The apparatus of claim 15 wherein said chiller comprises means for cooling both said liquid water and said hydrate-forming gas to a temperature of approximately 34° F.

20. The apparatus of claim 15 further comprising means for selectively connecting said mobile tank to the remainder of said apparatus for forming clathrate hydrates.

* * * * *